US011067328B2

(12) United States Patent
Lundqvist et al.

(10) Patent No.: US 11,067,328 B2
(45) Date of Patent: Jul. 20, 2021

(54) HYBRID COOLING APPLIANCE

(71) Applicant: Dometic Sweden AB, Solna (SE)

(72) Inventors: Anton Lundqvist, Älvsjö (SE); Xingbiao Yang, Zhuhai (CN); Yongbin Zhang, Zhuhai (CN); Junbao Li, Zhuhai (CN); Patrick McConnell, Lagrange, IN (US); Clayton Meyers, Middlebury, IN (US)

(73) Assignee: Dometic Sweden AB, Solna (SE)

( * ) Notice: Subject to any disclaimer, the term of this patent is extended or adjusted under 35 U.S.C. 154(b) by 237 days.

(21) Appl. No.: 15/778,931

(22) PCT Filed: Nov. 26, 2015

(86) PCT No.: PCT/CN2015/095688

§ 371 (c)(1),
(2) Date: May 24, 2018

(87) PCT Pub. No.: WO2017/088148

PCT Pub. Date: Jun. 1, 2017

(65) Prior Publication Data

US 2018/0320948 A1 Nov. 8, 2018

(51) Int. Cl.

| | |
|---|---|
| ***F25D 11/02*** | (2006.01) |
| ***F25B 25/02*** | (2006.01) |
| ***F25B 25/00*** | (2006.01) |
| ***F25D 11/00*** | (2006.01) |

(52) U.S. Cl.

CPC ..... *F25D 11/025* (2013.01); *F25B 25/00* (2013.01); *F25B 25/02* (2013.01); *F25D 11/00* (2013.01); *F25D 11/022* (2013.01); *F25D 11/027* (2013.01); *F25D 2201/126* (2013.01)

(58) Field of Classification Search

CPC ..... F25D 11/00; F25D 11/022; F25D 11/027; F25D 11/025; F25D 2201/126; F25B 25/00; F25B 25/02

See application file for complete search history.

(56) References Cited

U.S. PATENT DOCUMENTS

| | | | |
|---|---|---|---|
| 3,681,938 | A | 8/1972 | Blomberg et al. |
| 3,866,429 | A | 2/1975 | Blomberg |
| 3,866,431 | A | 2/1975 | Blomberg |

(Continued)

FOREIGN PATENT DOCUMENTS

| | | |
|---|---|---|
| AU | 2015415452 | 6/2018 |
| CA | 948871 | 6/1974 |

(Continued)

OTHER PUBLICATIONS

State Intellectual Property Office of the P.R. China, International Search Report and Written Opinion for PCT/CN2015/095688 dated Aug. 15, 2016.

(Continued)

*Primary Examiner* — Joseph F Trpisovsky
(74) *Attorney, Agent, or Firm* — Middleton Reutlinger

(57) ABSTRACT

A hybrid cooling system and a method of controlling the same. The hybrid cooling system comprises an absorption refrigeration system, a compression refrigeration system and a controller which operates the absorption refrigeration system and the compression refrigeration system in three modes.

27 Claims, 13 Drawing Sheets

(56) References Cited

U.S. PATENT DOCUMENTS

| | | | | |
|---|---|---|---|---|
| 3,953,983 | A * | 5/1976 | Sander | F25B 25/02 62/79 |
| 4,111,004 | A | 9/1978 | Blomberg | |
| 4,151,727 | A | 5/1979 | Blomberg | |
| 4,236,380 | A | 12/1980 | Blomberg et al. | |
| 4,242,879 | A | 1/1981 | Blomberg | |
| 4,253,311 | A | 3/1981 | Blomberg | |
| 4,257,758 | A | 3/1981 | Blomberg | |
| 4,286,569 | A | 9/1981 | Bergman et al. | |
| 4,362,029 | A | 12/1982 | Blomberg et al. | |
| 4,375,750 | A | 3/1983 | Blomberg | |
| 4,471,630 | A | 9/1984 | Sugimoto et al. | |
| 4,586,344 | A | 5/1986 | Lutz et al. | |
| 4,691,529 | A * | 9/1987 | Blomberg | F25B 25/02 62/332 |
| 4,819,445 | A | 4/1989 | Scherer | |
| 5,001,904 | A * | 3/1991 | Blomberg | F03G 7/065 60/527 |
| 5,038,574 | A | 8/1991 | Osborne | |
| RE34,030 | E | 8/1992 | Scherer | |
| 5,163,302 | A | 11/1992 | Swadner et al. | |
| 5,212,961 | A | 5/1993 | Graf | |
| 5,277,035 | A | 1/1994 | Fristoe et al. | |
| 5,372,011 | A | 12/1994 | O'Neal | |
| 5,402,653 | A | 4/1995 | Yanadori | |
| 5,419,145 | A | 5/1995 | Chandler et al. | |
| 5,577,388 | A | 11/1996 | Chandler et al. | |
| 5,729,993 | A | 3/1998 | Boiarski et al. | |
| 5,729,996 | A | 3/1998 | Barger | |
| 5,829,259 | A | 11/1998 | Chandler et al. | |
| 5,934,101 | A | 8/1999 | Takaki et al. | |
| 5,946,929 | A | 9/1999 | Selina et al. | |
| 6,187,220 | B1 | 2/2001 | Chandler | |
| 6,212,902 | B1 | 4/2001 | Leistner | |
| 6,259,227 | B1 | 7/2001 | Gherman et al. | |
| D461,482 | S | 8/2002 | Wissinger et al. | |
| 6,527,974 | B1 | 3/2003 | Chandler | |
| 6,612,116 | B2 | 9/2003 | Fu et al. | |
| 6,698,233 | B2 | 3/2004 | Pfister et al. | |
| 6,834,510 | B1 | 12/2004 | Pfister et al. | |
| 6,923,018 | B1 | 8/2005 | Pfister et al. | |
| 7,050,888 | B2 | 5/2006 | Schneider et al. | |
| 7,055,335 | B2 | 6/2006 | Van Leeuwen | |
| 7,155,927 | B2 | 1/2007 | Sawada et al. | |
| 7,266,967 | B2 | 9/2007 | Inoue et al. | |
| 7,269,968 | B2 | 9/2007 | Harder et al. | |
| 7,360,375 | B2 | 4/2008 | Mola et al. | |
| 7,386,984 | B2 | 6/2008 | Zhang et al. | |
| 7,966,842 | B2 | 6/2011 | Kamisako et al. | |
| 8,245,524 | B2 | 8/2012 | Kuehl | |
| 9,399,988 | B2 * | 7/2016 | Brooke | F25B 1/02 |
| 2005/0039469 | A1 * | 2/2005 | Nonaka | F25B 49/025 62/129 |
| 2005/0200253 | A1 | 9/2005 | Wissinger et al. | |
| 2006/0144073 | A1 | 7/2006 | Lee et al. | |
| 2007/0042698 | A1 | 2/2007 | Negley et al. | |
| 2008/0060366 | A1 | 3/2008 | Leistner et al. | |
| 2008/0067909 | A1 | 3/2008 | Hanson et al. | |
| 2008/0067910 | A1 | 3/2008 | Butler | |
| 2009/0273264 | A1 | 11/2009 | Butler | |
| 2010/0126185 | A1 | 5/2010 | Cho et al. | |
| 2011/0173998 | A1 | 7/2011 | Coleman et al. | |
| 2012/0102981 | A1 * | 5/2012 | Klein | F25B 49/043 62/56 |
| 2012/0186273 | A1 | 7/2012 | Arrigo et al. | |
| 2012/0198862 | A1 | 8/2012 | Arrigo | |
| 2015/0121916 | A1 * | 5/2015 | Rigaud | F25B 17/08 62/101 |
| 2018/0106529 | A1 * | 4/2018 | Cur | F25B 39/00 |
| 2018/0222278 | A1 * | 8/2018 | Mizuma | B60H 1/00428 |

FOREIGN PATENT DOCUMENTS

| | | |
|---|---|---|
| CA | 957171 | 11/1974 |
| CA | 1114479 | 12/1981 |
| CA | 1120140 | 3/1982 |
| CN | 201463399 U | 5/2010 |
| CN | 101893347 A | 11/2010 |
| CN | 201852389 U | 6/2011 |
| CN | 102223018 A | 10/2011 |
| CN | 102252449 A | 11/2011 |
| CN | 104471329 A | 3/2015 |
| CN | 108351130 | 7/2018 |
| DE | 2212890 | 9/1972 |
| DE | 2110690 | 7/1975 |
| DE | 112015007034 | 7/2018 |
| FI | FI833203 | 3/1984 |
| HU | 173179 | 3/1979 |
| WO | 2017088148 | 6/2017 |

OTHER PUBLICATIONS

Australian application No. 2015415452, filed on May 18, 2018.
First Office Action issued in CN Application No. 201580084384 dated Mar. 3, 2020.
Second Office Action issued in CN Application No. 201580084384.2 dated Nov. 25, 2020.

* cited by examiner

HYBRID COOLING APPLIANCE

CLAIM TO PRIORITY

This 371 National Stage Entry Patent Application claims priority to and benefit of, under 35 U.S.C. § 119(e), PCT application number PCT/CN2015/095688, filed Nov. 26, 2015, titled, "Hybrid Cooling Appliance", which is incorporated by reference herein.

BACKGROUND

Field of the Invention

Present embodiments relate to a hybrid cooling appliance, such as for example, a refrigerator having two independent refrigeration systems. More specifically, present embodiments relate to a cooling appliance, such as a hybrid refrigerator which utilizes an absorption refrigeration system and a compressor refrigeration system wherein the systems may be run independently or together depending on the characteristics and desires necessary to provide cooling.

Description of the Related Art

While traveling or camping in a recreational vehicle (RV), many campers or motor coach type RV systems utilize refrigerators onboard. It is desirable to provide refrigerators so that the people utilizing the RV may store fresh or frozen foods for cooking and/or eating as needed. Yachts and other marine craft may also use such refrigerators.

Many current refrigeration systems which are utilized with RVs and marine craft have a disadvantage in that cooling speed may be slow and the systems may be less energy efficient than desired. Still further, an additional issue develops when ambient temperature that is high such that the cooling performance of the refrigeration system is reduced.

On the other hand, alternate refrigeration systems are generally louder and require electricity for use. When an RV is utilized in a wooded area where electricity may not be available, the alternate refrigeration system may not be usable and therefore, fresh or frozen food may spoil.

A further challenge of controlling temperature in two separate compartments, for example freezer and refrigerator, with a single cooling system is to balance the temperature in the two compartments when ambient temperature varies. This is a particular challenge in RV refrigerators where ambient temperature significantly, and hence the cooling power required for each compartment, varies. In a compressor cooling system this can be adjusted through the use of a mechanical valve distributing the refrigerant between the two compartments. This can be a relatively costly solution. Alternatively, an absorption system may add heat by way of electric heater or combustion, which has limited regulating potential and is also energy inefficient.

Still further, in an appliance for an RV or marine craft it is desirable to utilize a power source which may utilize various power sources. When RV camping, some sites provide AC power, while most RVs also include DC power or fuel connections such as for propane, butane, natural gas or combinations thereof.

Accordingly, it would be desirable to provide a refrigeration system which overcomes known disadvantages of existing refrigeration systems in order to provide an energy efficient system. Further it would be desirable to provide a refrigeration system which efficiently cools or maintains fresh or frozen food. Still further it would be desirable to provide a refrigeration system which compensates for a high rate of opening and closing the refrigerator during high use times.

The information included in this Background section of the specification, including any references cited herein and any description or discussion thereof, is included for technical reference purposes only and is not to be regarded subject matter by which the scope of the invention is to be bound.

SUMMARY

Present embodiments provide a hybrid refrigerator cooling system which provides two cooling systems which may work independently or which may work together to provide cooling. The cooling systems may comprise an absorption refrigeration system and a compression refrigeration system. These systems may be equally sized or one system may have a higher cooling capacity than the other system wherein such is a primary cooling system and the other is a secondary cooling system. The hybrid refrigeration system allows: selection of operating power or source where options are available, optimization of operation, for example when reduced gas consumption or when grid power is available, performance when both gas and grid power are available, or gas when grid is not available and an optimized average. It would be further desirable to provide a method of controlling the two refrigeration systems to provide energy efficient use regardless of the power/fuel source and the conditions known with camping.

According to some embodiments, a hybrid cooling appliance comprises a cabinet having cooling mechanicals mounted on the cabinet. At least one door may be positioned on a front side of the cabinet covering an opening. The cooling mechanicals including an absorption refrigeration system and a compressor refrigeration system, a controller which operates the absorption refrigeration system and the compressor refrigeration system, the controller being capable of operating in three modes: a first mode wherein one of the absorption refrigeration system and the compressor refrigeration system operates alone, a second mode wherein the other of the absorption refrigeration system and the compressor refrigeration system operates alone, and a third mode wherein both the absorption refrigeration system and the compressor refrigeration system operate simultaneously.

Optionally, the hybrid cooling appliance may comprise a controller which provides for one or more of automated selection of energy supply and manual selection of energy supply. The absorption refrigeration system may include a gas fuel supply. The absorption refrigeration system may further comprise an electric heater. The heater may comprises one or both of an alternating current (AC) heater or a direct current (DC) heater. The compressor refrigeration system may include a compressor with a refrigerator circuit. The hybrid cooling appliance may further comprise an inverter. The hybrid cooling appliance may further comprising a fresh food refrigerator in the cabinet. The hybrid cooling appliance may further comprise a freezer in the cabinet. The hybrid cooling appliance may further comprise an evaporator disposed on the cabinet. The evaporator may comprises a compressor evaporator and an absorption evaporator. In some embodiments, the compressor evaporator and the absorption evaporator may be one of in direct contact, in thermal communication with separate thermal transfer plates or in thermal communication with a single thermal transfer plate. The single thermal transfer plate and the one or more separate thermal transfer plates include a plurality of cooling fins. The hybrid appliance may be optimized for operation for at least one of: when reduced gas consumption or when grid power is available, performance when both gas and grid power are available, or gas when grid is not available and an optimized average. The compressor refrigeration system and the absorption refrigeration system may be mounted to an insulator. The insulator being a foam material. The insulator may be positioned on the cabinet. The cabinet including an opening to accept the insulator. The hybrid cooling appliance may include an evaporator for each of the absorption refrigeration system and the compressor refrigeration system extending through the insulator. The absorption refrigeration system and the compressor refrigeration system may be a single evaporator or may be at least two evaporators. The hybrid cooling appliance may further comprise an ice maker which is disposed adjacent to an evaporator of the compressor refrigeration system. The compressor refrigeration system may cool a freezer and the absorption system may cool a fresh food refrigerator. The compressor refrigeration system and the absorption refrigeration system may both be cooling communication with at least one of a fresh food refrigerator and a freezer.

According to some embodiments, a hybrid cooling appliance module comprises an insulator which corresponds in shape to an opening a receiving location on a refrigerator cabinet, a compressor refrigeration system and an absorption refrigeration system located on the insulator, at least one line evaporator line extending from an evaporator of the compressor refrigeration system which is connectable to an evaporator line extending into the refrigerator compartment, at least one first evaporator line extending from an evaporator of the absorption refrigeration system, at least one first evaporator line extending from an evaporator of the compressor refrigeration system.

According to another embodiment, a method of operating a hybrid refrigerator comprises cooling a refrigerator cabinet with said compressor refrigeration system when an ambient temperature is below a preselected temperature or when a low volume is desirable, cooling the refrigerator with an absorption refrigeration system when a preselected cabinet temperature is obtained, determining when to use one or both of said compressor refrigerator system and the absorption refrigeration system and which of the systems.

Optionally, the method may further comprise powering off the compressor refrigeration system when electricity is not available. The method may further comprise powering off the compression refrigeration system when a preselected cabinet temperature is reached. Selecting between one or both of the compression and the absorption refrigeration systems. The method may further comprise utilizing the compression refrigeration system when higher speed cooling is desired. One system may be used to determine the need to start the other and where this is determined by measuring the thermal response of the temperature in the cooling compartment after starting the first system. The condenser of the compression refrigeration system may be actively cooled with a fan and wherein the fan is positioned in such a way that the air-flow is also used to cool at least one of the absorber or condenser of the absorption refrigeration system. The condenser fan may operate independently of the compression cooling system and thereby provides cooling of the absorption refrigeration system.

All of the above outlined features are to be understood as exemplary only and many more features and objectives of a hybrid refrigerator may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the hybrid cooling appliance will now be described by way of examples. These embodiments are not to limit the scope of the claims as other embodiments of the hybrid cooling appliance will become apparent to one having ordinary skill in the art upon reading the instant description. Non-limiting examples of the present embodiments are shown in pictures wherein:

DETAILED DESCRIPTION

Figure 1:
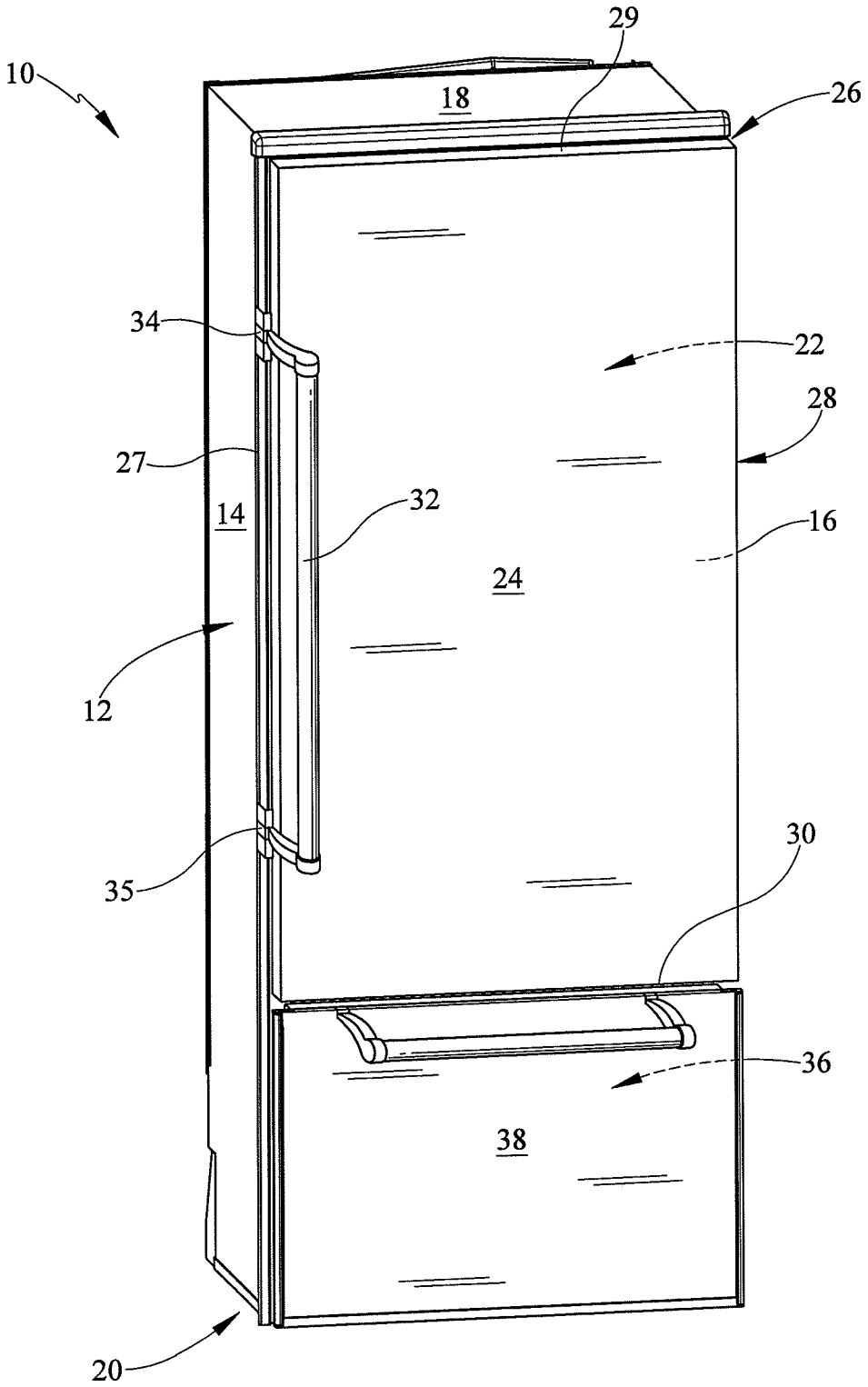
FIG. 1 is a front perspective view of an exemplary cooling appliance, such as a refrigerator.

It is to be understood that the hybrid cooling applicant is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the figures, wherein like numerals indicate like elements throughout several views, there are shown in FIGS. 1-13 various embodiments of a hybrid cooling appliance. In some embodiments, the hybrid cooling appliance may be, but is not limited to, a refrigerator and/or a freezer. The hybrid cooling appliance utilizes an absorption refrigeration system and a compressor refrigeration system, also referred to herein as a compression refrigeration system, to provide cooling for the appliance. The systems may be used independently or together to cool one or more compartments within the appliance.

Referring now to FIG. 1, a front perspective view of an exemplary cooling appliance 10 is depicted. The appliance 10 may be embodied by a refrigerator, freezer, combination or other device which is utilized to cool and store fresh or frozen foods. Although the term "refrigerator" is utilized throughout this specification, the appliance should not be limited to a refrigerator specifically as other appliances may be utilized and implemented in standalone fashion or in combination with other structures or appliances. The refrigerator 10 comprises a cabinet 12 having a first side wall 14, a second side wall 16 and a top 18. The cabinet 12 may also comprise a bottom 20 and a rear side wall 17 (FIG. 3) to define an enclosure.

Figure 2:
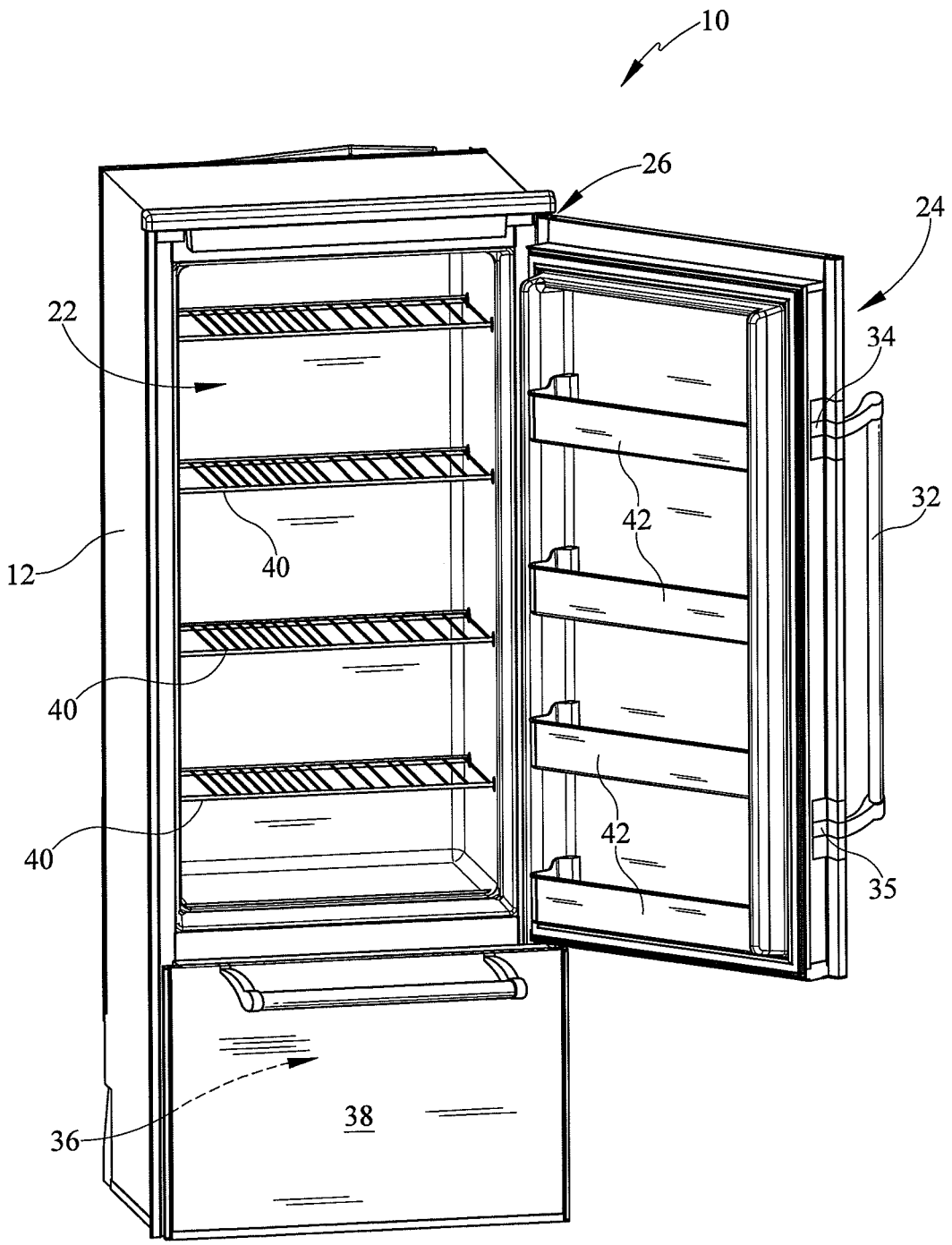
FIG. 2 is a front perspective view of exemplary refrigerator of FIG. 1 with the door in an opened position.

Along the front of the cabinet 12 is a door 24. Within the cabinet 12 is an upper compartment 22 behind the door 24. The upper compartment 22 provides a location for food storage, for example fresh or frozen. The door 24 is connected by a hinge structure 26 which allows the door to swing between a closed position, as depicted, and an open position, as shown in FIG. 2. The hinge structure 26 may be internal or external to the cabinet 12. The door 24 comprises a plurality of vertical edges 27, 28 and horizontal top and bottom edges 29, 30. These edges provide a boundary for the door 24 which may be opened by engaging a handle 32. The handle 32 is connected to locking latch assemblies 34, 35 to disengage the door 24 from the cabinet 12 along edge 27 and allow for pivoting opening of the door 24 at the hinge 26. Although the door 24 is shown with hinge 26 on the right side and handle 32 located on the left, the hinge and handle locations may be reversed to change the opening direction of the door 24. In still other embodiments, French or double doors may be used to close the upper compartment 22.

Certain regulations require that RVs may have a locking latch mechanism to retain doors and drawers in a closed position so that, for example the door 24 does not open when the RV is on an incline or moving and the contents therein spill out or become projectiles. Accordingly, the handle 32 may be actuated to disengage the locking latch assemblies 34, 35.

Referring still to FIG. 1, the refrigerator 10 includes a lower compartment 36 and a lower drawer 38 which is slidably positioned therein. In some embodiments however, the drawer 38 may also be a lower door. Still further, it should be understood by one skilled in the art that the larger upper compartment 22 and smaller lower compartment 36 may be a single compartment or alternatively, may be reversed so that the larger compartment is on the bottom and the smaller compartment is on the top. Still even further, the upper compartment 22 may also be provided to function as a slidable drawer and the lower compartment 36 be a hinged door opposite to the depicted configuration. Thus, various alternate constructions may be utilized with the hybrid cooling appliance. Further, one skilled in the art should understand that the lower compartment 36 may, according to some embodiments, be a freezer while the upper compartment 22 covered by the door 24 may be a refrigerator. However, in alternate embodiments, the refrigerator 10 may have a single compartment which is all refrigeration or a single compartment which is all freezer functionality. Further, the design may utilize an upper freezer compartment and lower refrigerator or vice versa.

Referring now to FIG. 2, a front perspective view of the refrigerator 10 is depicted. The door 24 is shown in an open position to reveal the upper compartment 22. Within the upper compartment 22 may be a plurality of trays 40 which provide spacing for positioning of multiple fresh food products. Additionally, the door 24 may comprise a plurality of bins 42 located along a rear surface in order to allow for additional storage of goods to be stored in the upper compartment 22.

Further, beneath the door 24 is the lower compartment 36 which is shown in a closed position by the drawer 38. However, as previously indicated, the drawer, or alternatively a door 38, may be opened to provide use to the compartments 22 of the refrigerator cabinet 12. This door 38 may be slidably or hingedly connected.

Figure 3:
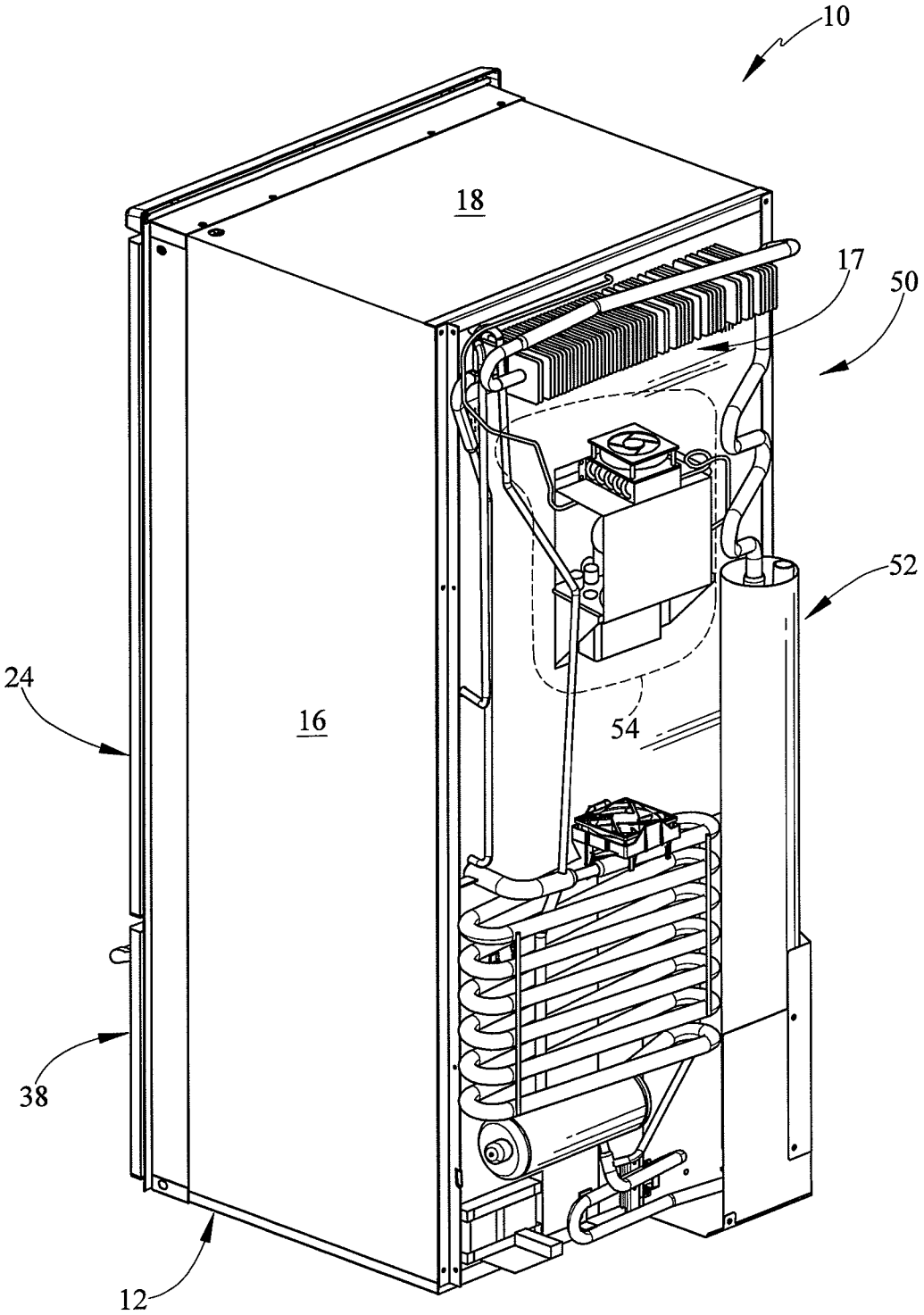
FIG. 3 is a rear perspective view of the exemplary refrigerator and a view depicting the components thereof.

Referring now to FIG. 3, a rear perspective view of the exemplary refrigerator 10 is depicted. In this view, the cabinet 12 is shown with the side wall 16 and top wall 18, and the rear wall 17, which was not depicted in FIGS. 1 and 2. On the rear of the refrigerator 10 are cooling mechanicals 50 which provide cooling for the refrigerator 10. By placing the cooling mechanicals 50, including the absorption refrigeration system 52 and compression refrigeration system 54 on the rear side 17 of the refrigerator 10, they are hidden from view and provide a more aesthetically pleasing presentation of the refrigerator 10.

In the exemplary embodiment, the refrigerator 10 has a hybrid cooling system or cooling mechanical 50 wherein an absorption refrigeration system 52 is provided and a compression refrigeration system 54 which is partially enclosed in the broken line depicted.

The absorption refrigeration system 52 and the compression refrigeration system 54 may function in a variety of manners. According to one embodiment, the refrigeration capacity of both systems may be the same. According to other embodiments, the refrigeration capacity of one of the absorption refrigeration system 52 and the compression refrigeration system 54 may be different so that one of the two has a larger capacity than the other of the two. Thus for example, one of the absorption refrigeration system 52 and the compression refrigeration system 54 may have higher cooling capacity than the other or vice-versa. For example, according to some embodiments, the absorption refrigeration system 52 may have a larger capacity to cool than the compression refrigeration system 54. In such embodiment, it may be desirable that the absorption refrigeration system 52 is utilized as the primary cooling means for the refrigerator 10. Additionally, when higher refrigeration capacity is needed, such as at high use times or when the refrigerator 10 has been unused for an extended period and rapid cooling is desired, the compression refrigeration system 54 may be utilized in addition to the absorption refrigeration system 52 to provide rapid cool down of the refrigerator 10 and specifically the compartments 22, 36 (FIG. 1) of the cabinet 12. High use times may be when the doors 24, 38 are opened and closed repeatedly or when a large amount of food is added to the at least one compartment 22, requiring added cooling. In other embodiments, the compressor refrigerator system 54 may be larger capacity.

Other factors may weigh in determining which system to operate or both. As previously described, each of the absorption and compression refrigeration systems 52, 54 have inherent disadvantages. For example, the absorption refrigeration system 52 may be slower to cool a cabinet and generally is a higher energy consumer than the compression refrigeration system 54. Further, the absorption refrigeration system 52 cooling performance decreases when ambient temperatures are higher. Thus, if an RV has been unused for an extended period of time and rapid cooling is needed of the refrigerator 10 to store food products but the RV is hot inside due to lack of air conditioning being utilized, these factors weigh against the performance of the absorption refrigeration system.

On the other hand, compression refrigeration systems have certain disadvantages as well. In most cases compression refrigeration systems are louder than absorption refrigeration systems. Further, with regard to RV usage in camping or wooded areas where electricity may not be available, compression systems are generally not operable by way of gaseous fuel such as for example, propane, butane or natural gas or mixtures thereof powering. Other fuels may be utilized as well and therefore, this list should not be considered exhaustive.

Still further, absorption and compression refrigeration systems 52, 54 each have inherent advantages as well. The absorption refrigeration systems 52 are generally quieter than compression refrigeration systems 54. On the other hand, compression refrigeration systems 54 generally exhibit higher cooling performance versus absorption refrigeration systems 52.

Keeping these factors in mind, the hybrid refrigeration system provides for three modes of operation. In a first mode, one of the absorption and refrigeration systems 52, 54 may operate alone. In a second mode, the other of the absorption and refrigeration systems 52, 54 may operate alone. In still a third mode, both of the absorption and compression systems 52, 54 may be operated together. The hybrid refrigeration system may be utilized to reduce noise and accelerate cooling times for the refrigerator cabinet 12. The hybrid refrigeration system may also allow for selection of operation of the desired refrigeration system or selection of both of the absorption and compression refrigeration systems 52, 54 dependent upon various factors including, but not limited to, power source available and/or fuel supply availability, and desired priority of use of such power sources and fuels. Such prioritization is advantageous and may be learned or be pre-programmed for various conditions to optimize optimization.

For example, when rapid cooling is needed or a high usage of the refrigerator 10 is occurring, by way of multiple door opening and closing events, both of the absorption and compression refrigeration systems 52, 54 may be selected for use either manually or by a controller. Alternatively, if during camping at a site where no electricity is available, the absorption refrigeration system 52 may be used solely. Such selection may occur manually by the user or may be determined by a controller. Still further, if an RV is parked at a site where electrical power (AC) is available, it may be desirable to run the compression refrigeration system 54 alone since the electricity is available and since the compression refrigeration system 54 may operate at a higher efficiency than the absorption refrigeration system 52. This may also be dependent upon whether the compression refrigeration system 54 has a capacity which is equal to the absorption refrigeration system 52.

In the embodiments where the compression refrigeration system 54 is of a smaller capacity, it may be desirable to run the compression refrigeration system 54 when the refrigerator is already cooled to a desired temperature and/or when noise level is not as high of a concern and when usage of the refrigerator 10 by way of opening and closing of the at least one door is expected to be at a lower frequency. Various scenarios may be accommodated by the use of the hybrid refrigeration system.

Figure 4:
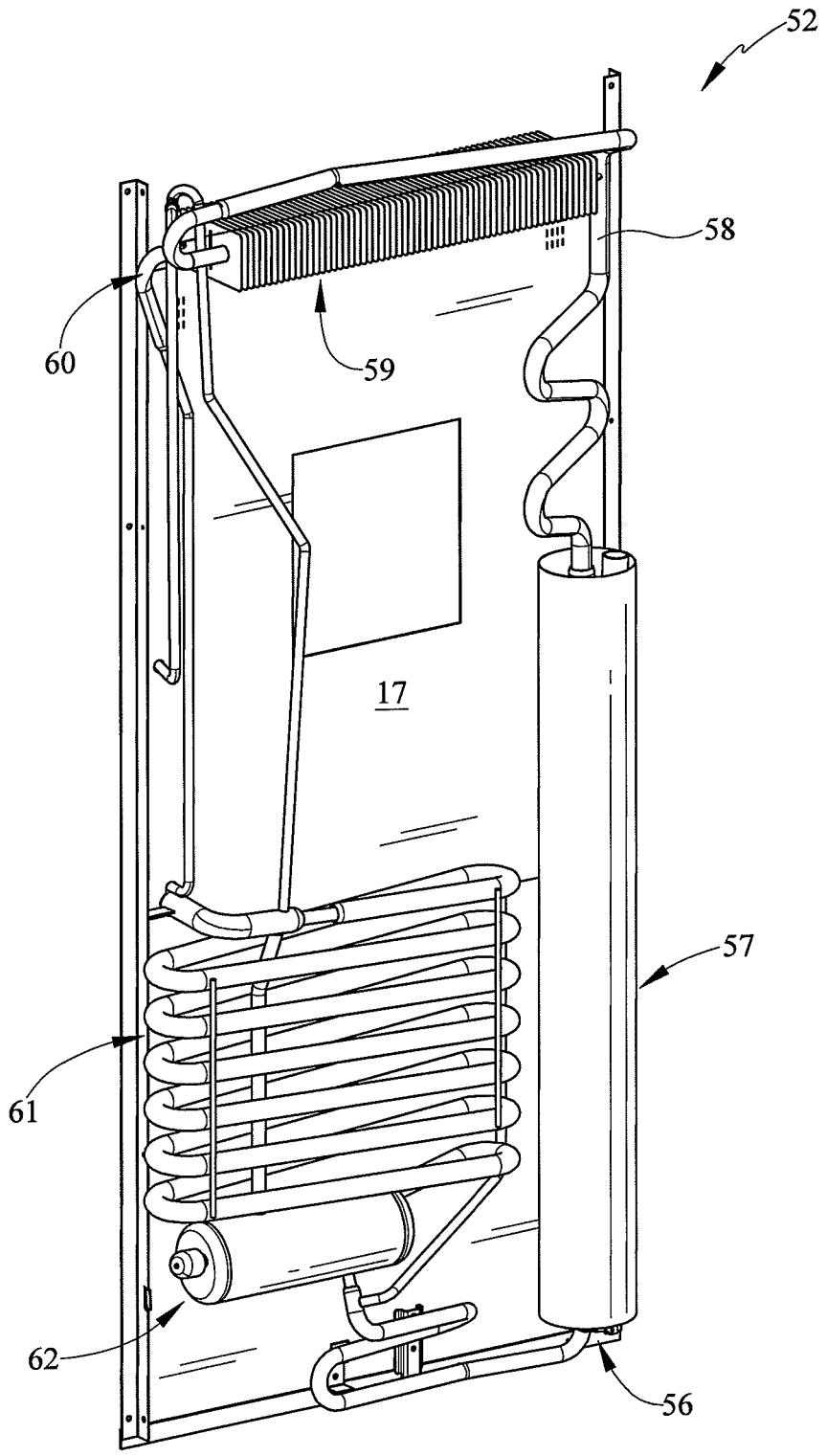
FIG. 4 is a rear perspective view of the absorption refrigeration system removed from the rear of the refrigerator cabinet.

Referring now to FIG. 4, the absorption refrigeration system 52 is shown on the rear side 17 of the refrigerator 10 (FIG. 1) wherein the remainder of cabinet 12 has been removed. The absorption refrigeration system 52 utilizes a burner 56, or alternatively electric heater, which is generally located near the bottom of the rear wall 17. The burner 56 heats a boiler vessel 57 which may comprise a refrigerant fluid therein. The refrigerant fluid may comprise various mixtures and according to one embodiment, may be a mixture of ammonia, water and hydrogen to generate the refrigerant in the absorption refrigeration system 52. Extending from the boiler vessel 57 is a water separator 58 which is defined by a tube which extends upwardly from the boiler vessel 57 in a curvilinear fashion and extends further, generally horizontally, to a condenser 59. The condenser 59 removes heat from the fluid received from the water separator 58 and is in further communication with an evaporator 60. The evaporator 60 is partially shown adjacent to the separator 58 and the condenser 59 and extends behind the rear wall close to the at least one compartment 22, 36 of the refrigerator cabinet 12 (FIG. 1). The evaporator 60 is further in fluid communication with an absorber 61 which is comprised of a coiled tube extending from an upper location downwardly to the absorber vessel 62. The absorber vessel 62 is generally cylindrical in shape and hollow and is further in fluid communication with the boiler vessel 57 to complete the circuit for refrigeration.

In operation, the fluid mixture is heated in the boiler vessel 57 by the burner 56. The heated refrigerant fluid moves upwardly through the boiler vessel 57, which is in the shape of a column and continues moving upwardly through the tortuous path of the water separator 58. In other embodiments, the water separator 58 may be straight and/or tortuous and may include turbulators, dimples or other features to cause directional changes and/or turbulence in the fluid flow. Within the separator 58, the water and dissolved ammonia components of the refrigerant fluid are separated from the ammonia vapor and the ammonia vapor continues to pass through the condenser 59. Within the condenser 59, heat is removed from the ammonia vapor to condense the vapor before the now liquid refrigerant passes to the evaporator 60.

Within the evaporator 60, the liquid ammonia passes through tubing adjacent to the interior wall of the cabinet 12 (FIG. 1) and more specifically, adjacent to an inner wall of the at least one compartment 22, through the evaporation of ammonia, (FIG. 1). The evaporator 60 removes heat from the at least one compartment 22 to cool the inside of the refrigerator cabinet 12 (FIG. 1). At the upper end of the evaporator 60, near the top of the rear wall 17, the ammonia and hydrogen mixture is at its coldest temperature of the cycle. As the hydrogen and vapor mixture move downwardly through the evaporator 60, toward the absorber 61, the mixture of hydrogen and ammonia vapor increases in temperature and ammonia concentration as it gains heat from within the cabinet 12. Ultimately, the now completely gaseous mixture reaches the absorber vessel 62 and the absorber vessel 62 may further include water which is drained from the separator 58 and/or boiler vessel 57 so that the complete fluid mixture returns to the absorber 61 and/or absorbing vessel 62 and is further directed to the boiler vessel 57 for boiling by the burner 56 to continue the cycle.

Figure 5:
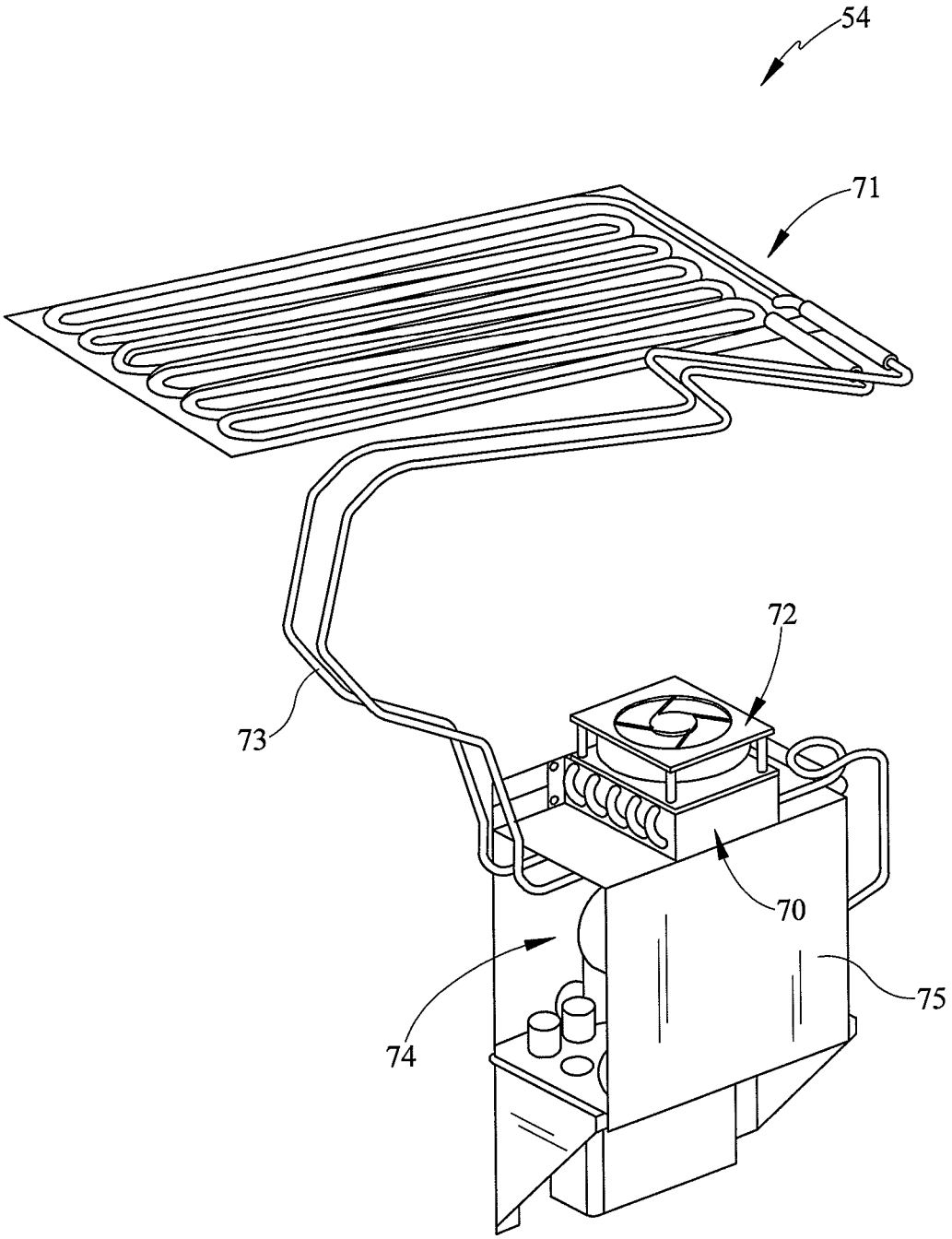
FIG. 5 is a rear perspective view of the compression refrigeration system removed from the rear of the refrigerator cabinet.

Referring now to FIG. 5, the compression refrigeration system 54 is shown removed from the rear wall 17 (FIG. 3) of cabinet 12 (FIG. 1). The compression refrigeration system 54 comprises a compressor 74 which is shown within a frame or housing assembly 75. The compressor 74 may be an alternating current (AC) compressor, a direct current (DC) compressor or may comprise one of each type. Also located on the frame 75 is a condenser assembly 70, including a fan 72. Located above the frame 75 is an evaporator 71 which is in fluid communication with the condenser assembly 70. The compressor 74, condenser assembly 70 and the evaporator 71 are in fluid communication to define a compressor refrigeration cycle.

With reference briefly to FIGS. 4 and 5, there are shown in some embodiments an evaporator 60 and a evaporator 71 in the two refrigeration systems 52, 54. The two evaporators 60, 71 may be separated from each other completely as shown in some embodiments. In other embodiments, the compression system evaporator 71 may be used to cool the absorption refrigeration system 52. This would eliminate the need for one of the evaporators. Still further embodiments may be provided where both evaporators 60, 71 may be connected to a cooling plate or fins which are connected to the cabinet 12 or within the cabinet 12 to improve heat transfer from the cabinet 12.

In operation, a refrigerant such as, for non-limiting example, R134a, R290, R600 may be utilized which is compressed by the compressor to raise the pressure of the refrigerant. The selection of refrigerant may be dependent on the objective in a current system where different refrigerants have different properties, such as ease of handling, cooling performance, energy efficiency, and/or combinations thereof. Various other properties may also be considered in refrigerant selection. The refrigerant is then directed to the condenser assembly 70 and the fan 72 is operated to decrease the temperature of the refrigerant such that the refrigerant changes from a gaseous state to a liquid. Further, the condenser assembly 70 may include an expansion valve to reduce the pressure of the refrigerant which further aids to change the state of the refrigerant from gas to liquid.

The refrigerant is then directed through the conduit or tubing 73 to the evaporator 71. The evaporator 71 is located within the cabinet 12 (FIG. 1) and according to the instant embodiment, is oriented and sized to fit within the top wall 18 (FIG. 3) and along the upper surface of the at least one inner compartment 22 (FIG. 1). In this manner, heat which rises within the compartment 22 is absorbed at the upper end. The evaporator 71 may be connected to a thermal transfer plate within the one or more compartments.

The thermal transfer of each evaporator 60, 71 may be provided by direct contact of the evaporators 60, 71 or may be by way of separate plates or may be a single plate such that the two systems are in direct thermal communication. With brief reference to FIG. 8, in some embodiments, the absorption refrigeration system 52 may be connected to, or in thermal communication with, a thermal transfer or cooling plate 64*a*. The thermal transfer plate 64*a* may be located in an internal wall or surface of the compartments 22, 36 for removal of heat from the interior of the cabinet 12. In some optional embodiments, the thermal transfer plate 65*a* may optionally include a plurality of cooling fins 65*a*. The cooling fins 64*a* may direct airflow over the plate 64*a* to improve heat transfer from within the compartment to the thermal transfer plate 64*a*.

Similarly, the compression refrigeration system 54 may also include a thermal transfer plate 64*b* located within the one or more compartments of the appliance. Optionally, as in the absorption system 52, the thermal transfer plate 64*b* may also include a plurality of cooling fins 65*b*. In this embodiment, both of the systems 52, 54 have separate thermal transfer plates 64*a*, 64*b* in thermal communication with corresponding evaporators. In either embodiment, an ice maker may be located adjacent to a thermal transfer plate or may be in direct contact with such or relative to an evaporator.

Figure 8:
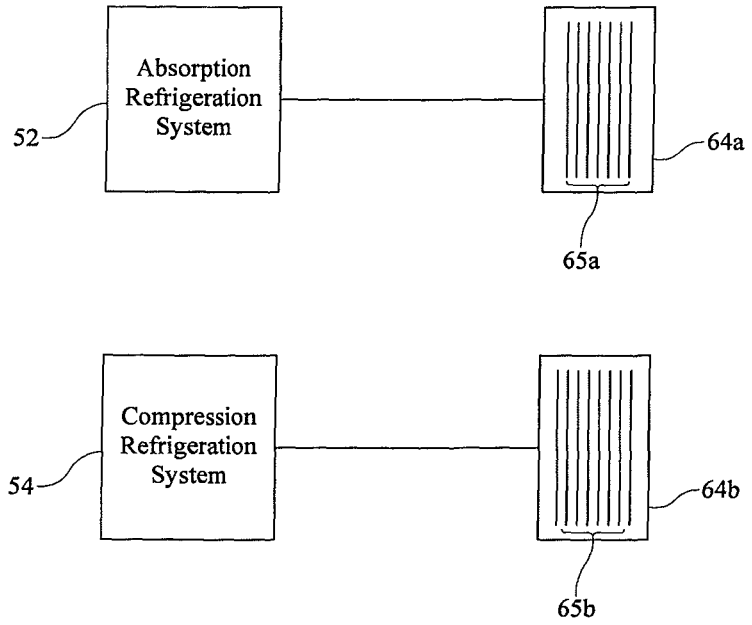
FIG. 8 is a first schematic view of the parallel cooling of a compartment and the thermal transfer plates therein.
Figure 9:
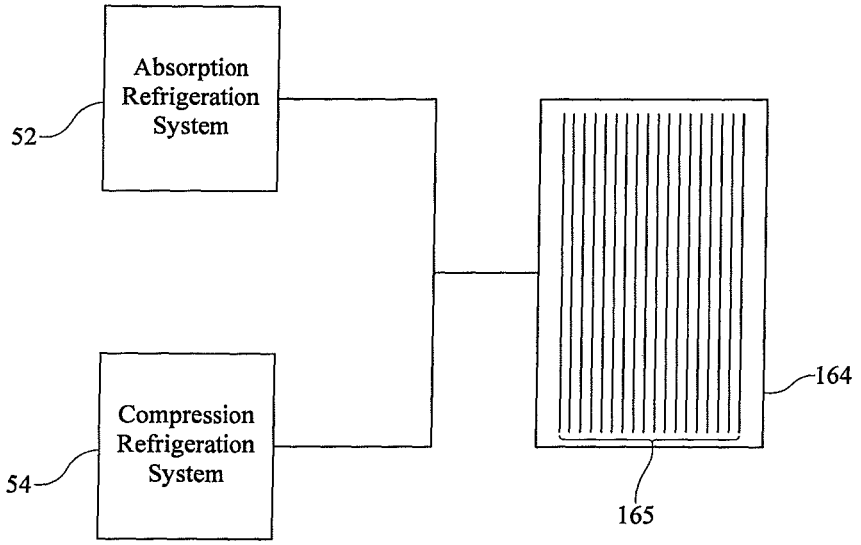
FIG. 9 is a second schematic view of an alternate parallel cooling configuration of a compartment and a single thermal transfer plate therein.

With brief reference now to FIG. 9, an alternate embodiment is provided wherein the two systems 52, 54 are in thermal communication with a single thermal transfer plate 164. In this embodiment, as will be understood by one skilled in the art, the thermal transfer plate 164 may be of a larger surface area than the previous embodiment. Further, as an option, the thermal transfer plate 164 may also include a plurality of cooling fins 165 to aid air flow across, and thermal transfer with, the thermal transfer plate 164. Thus, in contrast with the embodiment of FIG. 8, the evaporators of the systems 52, 54 may be connected to a single thermal transfer plate rather than separate plates.

Figure 6:
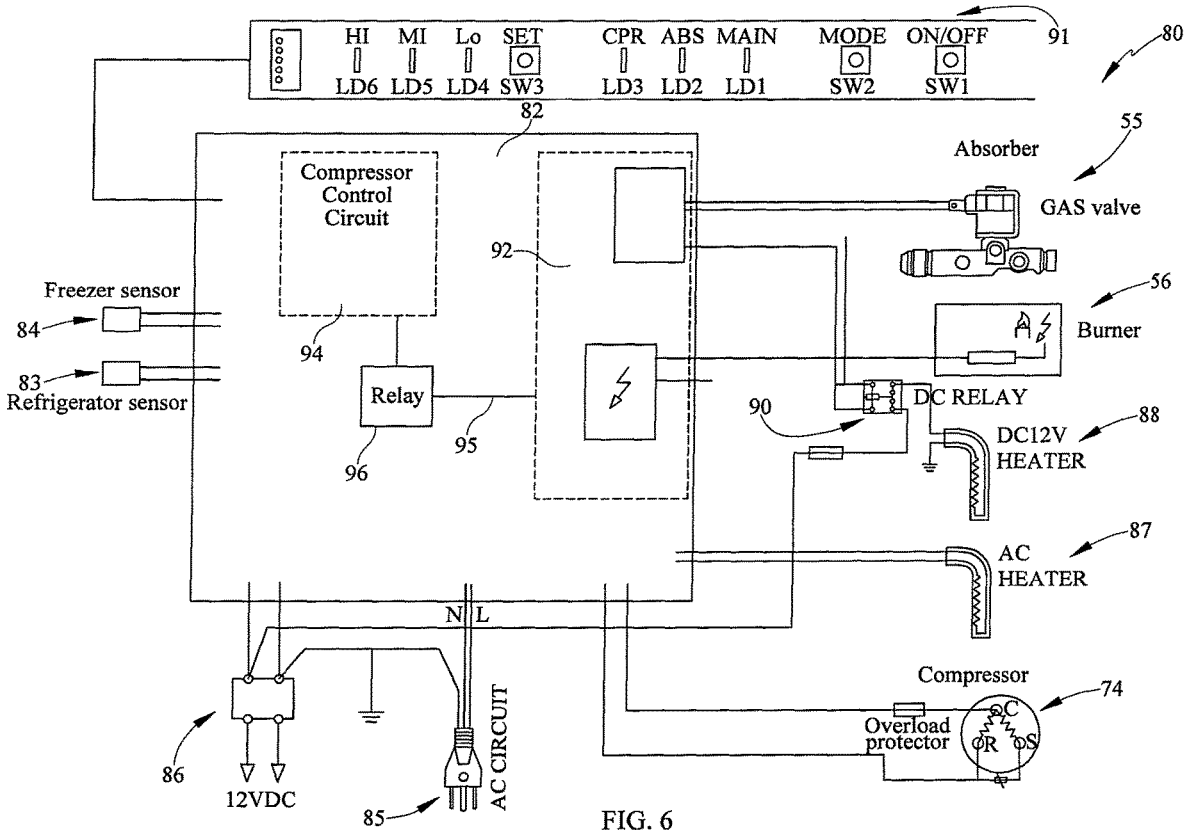
FIG. 6 is a schematic diagram of the refrigerator and the hybrid refrigeration system.

Referring now to FIG. 6, a schematic view of a controller 80 is depicted. As shown in the schematic view, the controller 80 may include a circuit board 82. The circuit board 82 has at least one temperature sensor 83, 84 which provides an input that may drive operation of either or both of the absorption refrigeration system 52 and the compression refrigeration system 54 (FIG. 3). The exemplary embodiment includes a refrigerator sensor 83 and a freezer sensor 84. Still further, an ambient temperature sensor may be provided to aid in determination by the controller 80 which system 52, 54 to utilize. At the end of the circuit board 82 are power supply inputs. In the instant embodiment, an alternating current input (AC) 85 is shown. This input may be utilized when the RV is located at a camp site or other location where electrical power hookup is available and may be 120 or 220 V depending on regional standards. Additionally, the circuit board 82 has a direct current (DC) power input 86. This may be provided by one or more batteries which are connected to the circuit board 82 for powering portions of the absorption and/or compression refrigeration systems 52, 54. The 12 Volt (V) DC supply may be utilized when an AC supply is not utilized, such as in a camp site or other location where electrical hookup for the RV is not available. An inverter may be used also to convert the DC voltage to AC voltage or alternatively AC voltage to DC voltage. This may be desirable, for example to power an AC compressor or AC heater or other AC components with DC power supply or alternatively, convert AC power supply to DC voltage to power DC components.

Also shown in electrical communication with circuit board 82 is the compressor 74. The compressor 74 is part of the compressor refrigeration system 54 previously described. Disposed above the compressor 74 are AC and DC heaters 87, 88. These heaters 87, 88 may be utilized depending upon the source of power which is available. The AC heaters 87 may be used to provide heat to the boiler vessel 57 (FIG. 4) of the absorption refrigeration system 52 when AC power input is available through the power AC input 85. Alternatively, or in addition to, the DC heater 88 is also shown and provided which provides power from DC supply 86. Additionally, a relay 90 is provided which may be connected to the electrical power, i.e. shore power, and may activate the compressor 74 to drive the compression refrigeration system 54 independent of the absorption refrigeration cycle 52. A gas valve 55 may be electrically controlled by the controller 80 to open and close for operation of the burner 56. Thus, when the absorption refrigeration system 52 is desired to operate, the controller 80 can direct such operation. The DC relay 90 is also provided as an output of the controller 80 to direct operation of the different heaters 87, 88 and combination of valve 55 and burner 56.

With reference still to FIG. 6, the control panel or user interface 91 may be described. The user interface 91 allows a person various controls for optimization of power use or to maximize or minimize cooling to conserve power without requiring training in refrigeration technology. The user interface 91 provides simple inputs and provides information about the status and operation mode of the system. According to the instant embodiment, an on/off switch for the system is labeled SW1. Adjacent to the switch SW1 is a SW2 which functions as a mode selector, where one may, for example determine the priority system. The priority may be either of compression refrigeration or absorption refrigeration and may be indicated by lights such as LEDs LD1 to LD3 indicate which system that is in operation. The lights LD1 to LD3 may also be used to indicate if the system is operating on gas or not. Further, the switch SW3 may also be used to set the desired SET point for the temperature in the refrigerator. In the instant embodiment, three set points are shown (HI, MED, LOW) however, digital readouts may be provided to obtain more selective temperature settings. The selection is indicated by the LEDs, LD 4-6.

It should be understood that such interface 91 can be further developed to include also other possibilities for controls. It should also be understood that LED's for example can have multiple functions e.g. by flashing, different light intensity/brightness in order to display various information and therefore may have more than a single meaning.

Figure 7:
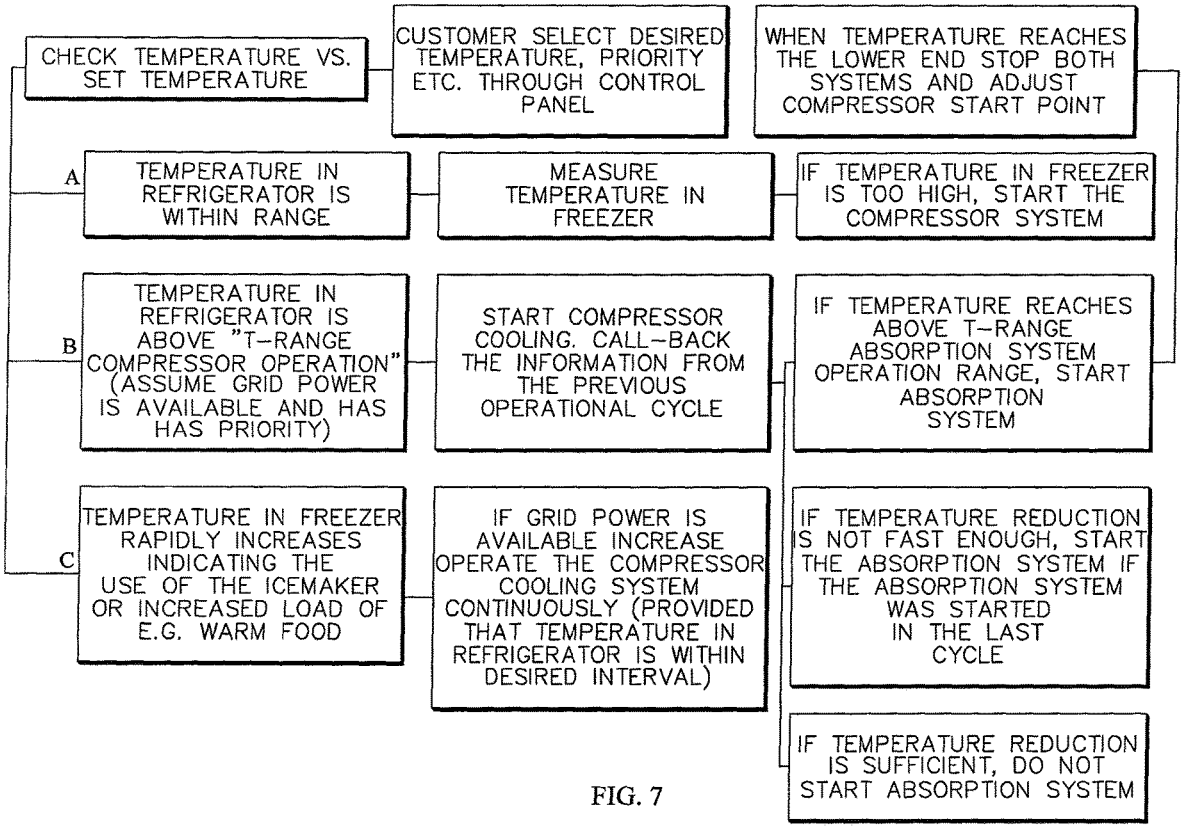
FIG. 7 is a flow chart for control method for the hybrid refrigerator.

Referring now to FIG. 7, a flow chart is provided depicting the control and decision making for the hybrid refrigerator. The flow chart shown in FIG. 7 is merely one embodiment and one skilled in the art will understand that other methods of controlling the refrigerator are within the scope of the present embodiments. A complete system may include various input, check points and control parameters and control of such may lead to a number of parallel possible events.

Figure 12:
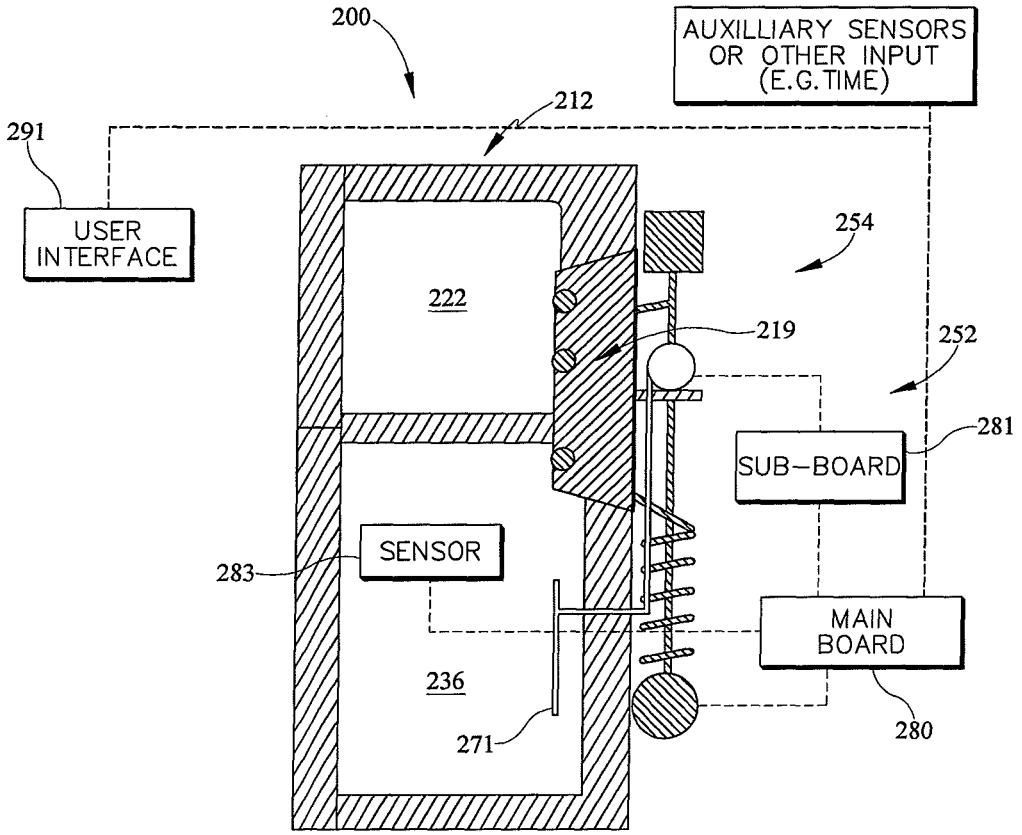
FIG. 12 is a side schematic view of a further embodiment of the hybrid refrigerator where the cooling system is controlled by a master system (absorption refrigerator) and controlled by the temperature in the refrigerator and the compressor system function as a secondary system to the absorption system; and, FIG. 13 is a chart showing the relationship of cycling between the compressor refrigeration system and the absorption refrigeration system between time and temperature.

The described system may include two sensors 83, 84 (FIG. 6), one in the refrigerator compartment 236 and one in the freezer compartment 222 (as depicted in FIG. 12). The hybrid refrigeration system may be balanced in such a way that the compressor cooling system cools a larger part of the freezer relative to the refrigerator. The user may select priority on electricity (DC) versus gas operation and/or grid/shore power if available.

The control system will continuously monitor the temperature in the compartments, compare to set points and, depending on the input, various flow paths may be followed.

In one embodiment, indicated generally along path A, the temperature in the refrigerator compartment is low enough but temperature in the freezer is too high. In prior art systems the refrigerator would be heated to force the refrigerator to start. Now instead, the compressor system 54 may start and since there is more cooling power in the freezer relative to the refrigerator, this will allow the freezer temperature to be reduced without necessarily dropping the temperature in the refrigerator.

According to another embodiment, indicated generally along path B, wherein grid/shore power has priority in the operation process. Given the priority settings, the temperature intervals for starting and stopping respective cooling systems may also automatically set in some embodiments. Since priority is for electrical operation, the compressor system 54 will start before the absorption system 52. It is then advantageous to avoid starting the absorption system 52 at all. The control system therefore includes various controls including measuring the impact of the start of the cooling system and events in the previous cooling cycle to determine if it is necessary to start the absorption system 52. Given the fact that it takes time to start the absorption system 52, and time to cool, it is important that starting of the absorptions system 52 is done early enough, if it is in fact necessary.

In still a further embodiment, indicated along path C, the system may detect a rapid change in the system indicating the use of e.g. an icemaker. To maximize the ice-making capacity, it is then advantageous to keep the system as cool as possible. Thus, even though the temperature during part of the cycle may be low enough to shut-off the cooling system, the system instead runs continuously in order to accumulate as much cooling as possible. However, priority is given to the refrigerator temperature since it is important to avoid the freezing of goods into that compartment In the present embodiments, the present system has a number of advantages over prior art refrigeration systems. In some embodiments, the two compartments 22, 36 may be maintained at different temperatures but this is difficult, especially where ambient temperature may widely vary as in an RV or marine craft. According to some embodiments, the cabinet 12 includes two compartments 22, 36. One or both of the compartments 22, 36 may have parallel cooling, meaning cooling by two or more refrigeration systems 52, 54. In the instance where one or both compartments have two evaporators 60, 71, the evaporators may be: (a) in direct contact with each other or separated, (b) may be in contact with one or more thermal transfer plates 64*a*, 64*b*, 164 or (c) may have one or more thermal transfer plates 64*a*, 64*b*, 164 having a plurality of cooling fins 65*a*, 65*b*, 165 (FIGS. 8, 9). These are exemplary and other embodiments may be used. For example, the evaporators 60, 71 may also be spaced apart so that they are not physically contacting or connected by any thermal transfer parts.

As a result of the parallel cooling of one or both compartments 22, 36, there may be improved temperature control in either compartment. In prior art systems, where a single refrigeration system was used to cool two compartments, either a valve needed to be operated for compression cooling systems, or alternatively, heat added by way of a burner for an absorption refrigeration system. Controlling temperature in one compartment without changing the temperature in the other was difficult. Present embodiments allow for improved control by providing two refrigeration systems 52, 54 in at least one compartment 22, 36 and by varying the operation time of either system for a given compartment.

An additional advantage of the instant embodiments is to increase cooling power and flexibility of system by allowing the separate or parallel operation of the absorption refrigeration system 52 and the compression refrigeration system 54. In RV refrigeration, which encounters various power or fuel sources, a normal priority or order of selection is: (a) AC power, (b) gas, (c) DC power. The instant embodiments increase the cooling power or capacity as previously noted, and also maintains the flexibility of utilizing various power or fuel sources.

As an example, in a situation where all power sources or fuels are available, one skilled in the art will recognize there are inherently different time constants of operation for compression refrigeration system 54 and absorption refrigeration systems 52. The startup time of a compressor refrigeration system 54 is shorter than that of the absorption refrigeration system 52 due to a larger thermal mass needing to be transferred before any cooling power is delivered to any of the compartments 22, 36. A significant difference in time constants may cause a conflict with the energy source priority selection system. If gas is priority but the absorption system 52 is slow, the compressor system 54 may still be overused for the cooling because it cools down faster. Alternatively if electricity is a priority, it may happen that the absorption system 52 starts but shuts down again before it starts to deliver any cooling because the compression system starts.

With this in mind, the present embodiments provide a system which preserves the energy selection and hybrid cooling capability. This is achieved, according to some embodiments, by utilizing the priority system and determining need for additional cooling from the secondary cooling system where priority and secondary systems may be automatic or may be by user selection. Still further, some embodiments may allow the user to make a selection and optionally, the controller to confirm such is an optimal selection for operation. In some embodiments, the priority system may be started and the effect on the temperature in the appliance control system can determine the need for starting the secondary system. In the present embodiments, the priority system may be one of the absorption system 52 or the compression refrigeration system 54 while the secondary system may be the other of the absorption system 52 or the compression system 54. Once the priority system is started, the temperature may be monitored to determine if additional cooling capacity from the secondary system is needed.

A further advantage of the present embodiments is related to electronic controls. In prior art systems, use of multiple cooling systems would require separate controls, especially since absorption refrigeration system controls may be complex due in part to gas safety regulations. Due to such complexity and related regulations it may be desirable to utilize the absorption refrigeration system as the primary cooling system and primary control circuit. However, it should be further understood by one skilled in the art that the compression cooling system may alternatively be the priority system and hence may be operated without the operation of the absorption cooling.

Present embodiments may utilize a controller 80 (FIG. 6) having a gas control circuit 92 (FIG. 6) as a master control and further comprises compressor control 94 which may comprise standard electronics. Such standard electronics may be constructed with minimum functionality, for example only to start and stop the compressor but without or with a minimum of control logic. In this configuration, the gas control circuit 92 may be the master control. This avoids risk associated with interference of the redundant gas control circuits. According to some embodiments, the controller 80 may have the gas control circuit 92 further comprising an output 95 that is able to operate a relay 96 which controls the compressor control circuit 94.

Still further, the present embodiments provide for improved ventilation of the absorption refrigeration system 52 which improves cooling capacity. In separate systems, an absorption refrigeration system generally is designed to avoid need for active ventilation. Compression systems, on the other hand, often operate with active cooling by way of a fan to remove heat from the condenser.

With that in mind, the present embodiments, may be configured to leverage the fan 72 (FIG. 5) of the compression system 54 condenser assembly 70. In some embodiments, the fan 72 of the compression refrigeration system 54 may be positioned to increase air flow to or over the absorption refrigeration system 52 and increase air flow over the absorption system condenser 59 (FIG. 4). Specifically, the fan 72 may be positioned to increase air flow over, and cooling of, the condenser 59 or the absorber 61 (FIG. 4) of the absorption refrigeration system 52. The fan 72 may be placed in various locations adjacent to the cooling mechanicals which may create the most efficiency gain, such as for non-limiting example, between the condenser 59 and the absorber 61. This increases the cooling capacity of absorption refrigeration system 52. As an additional feature, the fan 72 may be controlled and/or operated independently of the compressor 74 and thereby provide additional air flow even if the compressor 74 is not operating. This may be desirable as a means to further increase the performance of the absorption refrigerator system 52 in high ambient temperature conditions without having to start the compressor system 54, as a means of reducing the DC consumption.

Figure 10:
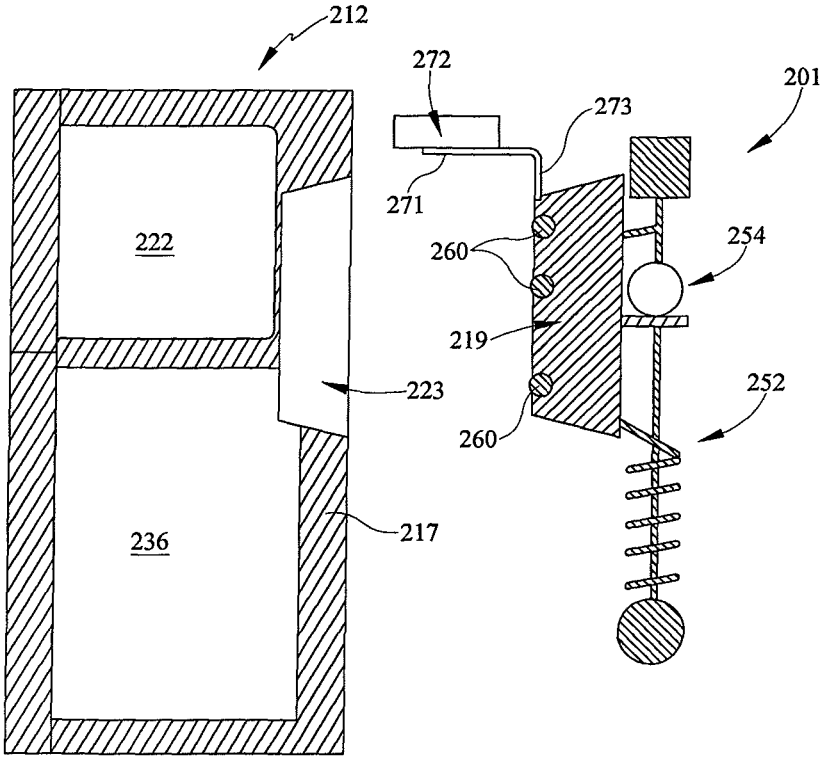
FIG. 10 is a side schematic view of an embodiment of the hybrid refrigeration including integration of the cooling systems into a replaceable component with a separate plate to allow cooling of an ice maker.

With reference now to FIG. 10, a side schematic view of an embodiment of the hybrid refrigeration system is depicted. An exemplary refrigerator cabinet 212 is depicted wherein a hole or other locating feature 223 is located in at least one wall of the cabinet 212. The locating feature 223, in at least one embodiment, is positioned in the rear wall 217 of the cabinet 212. The cabinet 212 may include a single compartment corresponding to a fresh food refrigerator 236 or a freezer 222, or may include two separated compartments corresponding to each of a fresh food refrigerator 236 and a freezer 222.

Exploded from the locating feature 223 is a schematically represented hybrid cooling system 201 which comprises a compressor refrigeration system 254 and an absorption refrigeration system 252. These systems may each include an evaporator or may utilize a single evaporator as shown in FIGS. 8 and 9.

The hybrid cooling system 201 includes the mechanicals being mounted on an insulator 219. In some embodiments, the insulator 219 is formed of a foam material. In other embodiments, the insulator 219 may be formed of various materials, including, but not limited to, EPS for example. The insulator 219 is formed of a shape which corresponds to the locating feature 223. This allows for proper orientation and positioning of the hybrid cooling system 201. This allows for flexible mounting of a standard absorption system 252, a compressor system 254 or a hybrid system with minimal changes to the overall product design.

Within the insulator 219 is conduit, lines, tubing or like 260, 273 which provides refrigerant fluid communication between the compressor and the absorption refrigeration systems and either one or two evaporators.

In the instant embodiment, the hybrid cooling system 201 may utilize the compressor refrigeration system 254 and the absorption refrigeration system 252 to cool the freezer 222 and the absorption system 252 to cool the fresh food refrigerator compartment 236. However, in alternate embodiments, both systems may be used to also cool the fresh food refrigeration system or one cooling system may be used for one compartment, for example the freezer. The conduits 260, 273 may be embedded in the insulator 219 and may extend to an exposed evaporator 271 or the evaporator 271 may be disposed within the walls of the cabinet 212.

Either of the configurations may also be utilized for the absorption refrigeration system 252. Still further, an ice maker 272 may be disposed adjacent to the evaporator 271 so that it is either in direct contact or in indirect contact with the evaporator 271.

Figure 11:
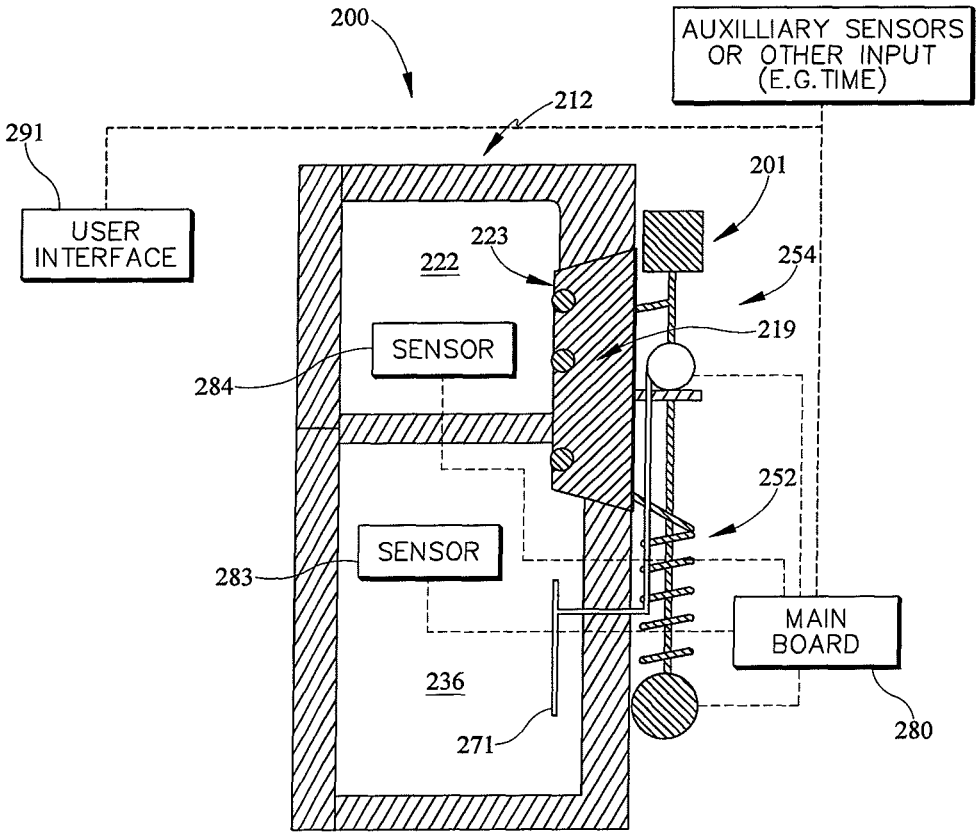
FIG. 11 is a side schematic view of another embodiment of the hybrid refrigerator where the cooling system is controlled through one main board with one or more sensors measuring the temperature in several compartments.

With reference now to FIG. 11, a side sectional view of the refrigerator 200 is depicted. The appliance 200 is shown with the hybrid cooling system 201 positioned within the locating feature 223 on a side of the cabinet 212.

The present embodiment shows a further alternative, wherein the compressor refrigeration system 254 is used to cool the fresh food refrigerator 236 as depicted by the compressor evaporator 271. Additionally the refrigerator 200 utilizes the absorption refrigeration system 252 with at least the fresh food refrigerator compartment 236. Thus, in this embodiment, the fresh food refrigerator compartment 236 has dual or hybrid cooling capability.

The refrigerator 200 may also include one or more sensors 283, 284, such as thermometers. The thermometers may be each located in the one or two compartments 222, 236. The refrigerator 200 is also shown with a control panel or user interface 291 and may be similar to the previously described controls. The depicted embodiment comprises a single controller board 280 in communication with the user interface 291.

With reference to FIG. 12, a side section view of the refrigerator 200 is shown. The embodiment includes a main control board 280 which may control either the absorption refrigeration system 252 or the compressor refrigeration system 254 and a remote secondary control board 281 may operate the other of the absorption and compressor refrigeration systems 252, 254. The instant embodiment utilizes the primary control board 280 to operate the absorption refrigeration system 252 and the secondary control board 281 to operate the compressor refrigeration system 254.

Figure 13:
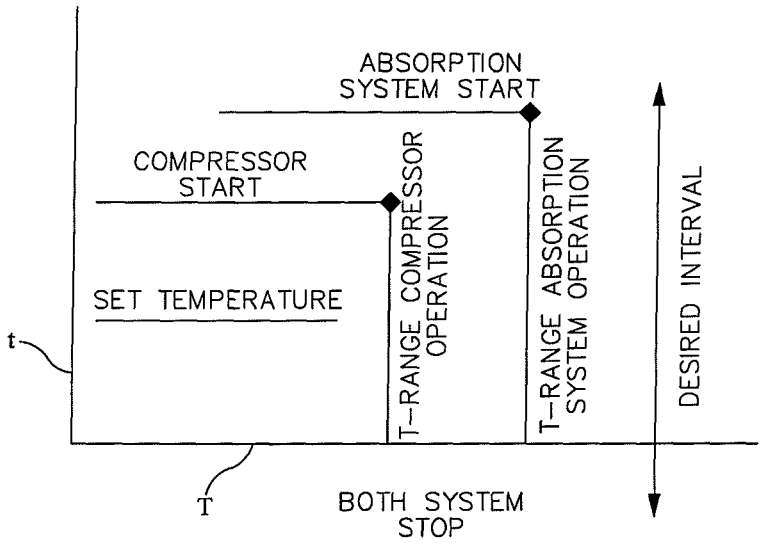

With reference now to FIG. 13, a further chart is shown depicting the cycling relationship, according to one embodiment, between the compressor refrigeration system 54 and the absorption refrigeration system 52. The chart depicts temperature T along the horizontal axis and time t along a vertical axis. The set temperature, as previously described, may be a desired temperature, as shown by a range represented by a horizontal line. To the right of the set temperature, is the temperature range for compressor operation and the compressor start temperature. When the temperature of the compartment exceeds the compressor start temperature, the compressor will operate to cool the compartment. To the right of the compressor, start temperature is absorption start temperature and to the right beyond that temperature is a temperature range where the absorption system operates. In operation, the compressor may be used to cool the cabinet where power requirements are met and available. However, where the compressor cannot keep the cabinet at a desired temperature, the absorption refrigeration system will activate to cool the cabinet. With the desired time interval, the controller may also have minimum or maximum times that the compressor may cycle or that the absorption system begins operation for cooling. Those may be predefined by programming into the controller 80 or may be learned by the controller 80. The absorption refrigeration system may be used to decrease the cycling of the compressor refrigeration system. Further, the compressor start point can be dynamically varied if cooling demand is high and absorption system wherein needed, the compressor start point may be moved to a lower temperature to enable the compressor refrigeration system to handle demand, without experiencing too frequent starting and stopping. Similar charts may be created for programming where the absorption refrigeration system is the primary cooling system.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A hybrid cooling appliance, comprising:

a cabinet having cooling mechanicals mounted on said cabinet, said cabinet having a compartment;

at least one door positioned on a front side of said cabinet covering an opening;

said cooling mechanicals including an evaporator on said cabinet, an absorption refrigeration system and a compressor refrigeration system, comprising a DC compressor, said absorption refrigeration system and said compressor refrigeration system both being capable of cooling the entire compartment;

a controller which operates said absorption refrigeration system and said compressor refrigeration system, said controller having AC and DC power input and electric control of a gas valve, said controller capable of operating in three modes:

a first mode wherein one of said absorption refrigeration system or said compressor refrigeration system operates alone;

a second mode wherein the other of said absorption refrigeration system or said compressor refrigeration system operates alone; and, a third mode wherein both said absorption refrigeration system and said compressor refrigeration system operate simultaneously;

wherein said evaporator comprises a compressor evaporator and an absorption evaporator;

further wherein said compressor evaporator and said absorption evaporator are one of in direct contact, in thermal communication with separate thermal transfer plates or in thermal communication with a single thermal transfer plate.

2. The hybrid cooling appliance of claim 1 comprising said controller which provides for one or more of automated selection of energy supply and manual selection of energy supply.

3. The hybrid cooling appliance of claim 1 wherein said absorption refrigeration system includes a gas fuel supply.

4. The hybrid cooling appliance of claim 3 wherein said absorption refrigeration system further comprises an electric heater.

5. The hybrid cooling appliance of claim 4 wherein said electric heater comprises one or both of an alternating current (AC) heater or a direct current (DC) heater.

6. The hybrid cooling appliance of claim 1 wherein said compressor refrigeration system includes a refrigerator circuit.

7. The hybrid cooling appliance of claim 1 further comprising an inverter.

8. The hybrid cooling appliance of claim 1 further comprising a fresh food refrigerator in said cabinet.

9. The hybrid cooling appliance of claim 8 further comprising a freezer in said cabinet.

10. The hybrid cooling appliance of claim 1 wherein said single thermal transfer plate or said one or more separate thermal transfer plates further comprise a plurality of cooling fins.

11. The hybrid cooling appliance of claim 1 wherein the hybrid cooling appliance is optimized for operation for at least one of: when reduced gas consumption or when grid power is available, performance when both gas and grid power are available, or gas when grid is not available and an optimized average.

12. The hybrid cooling appliance of claim 1, wherein said compressor refrigeration system and said absorption refrigeration system are mounted to an insulator.

13. The hybrid cooling appliance of claim 12, said insulator being a foam material.

14. The hybrid cooling appliance of claim 12, said insulator positioned on said cabinet.

15. The hybrid cooling appliance of claim 14, said cabinet including an opening to accept said insulator.

16. The hybrid cooling appliance of claim 12, wherein conduit for the evaporator for each of said absorption refrigeration system and said compressor refrigeration system extend through said insulator.

17. The hybrid cooling appliance of claim 16, wherein said absorption refrigeration system and said compressor refrigeration system comprises one of a single evaporator or at least two evaporators.

18. The hybrid cooling appliance of claim 12, further comprising an ice maker which is disposed adjacent to the evaporator of said compressor refrigeration system.

19. The hybrid cooling appliance of claim 12, said compressor refrigeration system cooling a freezer and said absorption refrigeration system cooling a fresh food refrigerator.

20. The hybrid cooling appliance of claim 19, said compressor refrigeration system and said absorption refrigeration system both being in cooling communication with at least one of the fresh food refrigerator or the freezer.

21. A method of operating a hybrid refrigerator, comprising:

cooling a refrigerator cabinet compartment with a DC compressor refrigeration system with a compression system evaporator in said refrigerator cabinet compartment when an ambient temperature is in a first condition relative to a preselected cabinet compartment temperature;

cooling said refrigerator cabinet compartment with an absorption refrigeration system with an absorption refrigeration system evaporator on said refrigerator cabinet compartment when said preselected cabinet compartment temperature is obtained or when a reduced sound volume is desirable;

providing that said DC compressor refrigeration system evaporator and said absorption refrigeration system evaporator are one of in direct contact, in thermal communication with separate thermal transfer plates or in thermal communication with a single thermal transfer plate;

determining, with a controller having both AC and DC input and electric control of a gas valve, when to use one or both of said DC compressor refrigeration system and said absorption refrigeration system and which of said DC compressor refrigeration system or said absorption refrigeration system.

22. The method of claim 21 further comprising powering off said DC compressor refrigeration system when electricity is not available.

23. The method of claim 21 further comprising powering off said DC compressor refrigeration system when said preselected cabinet temperature is reached.

24. The method of claim 21 further comprising selecting between one or both of said DC compressor refrigeration system and said absorption refrigeration system.

25. The method of claim 21 further comprising utilizing said DC compressor refrigeration system when higher speed cooling is desired.

26. The method of claim 21 where one of the absorption refrigeration system or the DC compressor refrigeration system is used to determine the need to start the other of the absorption refrigeration system or the DC compressor refrigeration system and where this determination is determined by measuring a thermal response of the temperature in the refrigerator cabinet compartment after starting a first of the absorption refrigeration system or the DC compressor refrigeration system.

27. The method of claim 21 where a condenser of the DC compressor refrigeration system is actively cooled with a condenser fan and wherein said condenser fan is positioned in such a way that air-flow is also used to cool at least one of an absorber or the condenser of the absorption refrigeration system.

* * * * *